US009995244B2

(12) United States Patent
Tanaka et al.

(10) Patent No.: US 9,995,244 B2
(45) Date of Patent: Jun. 12, 2018

(54) HEAT ENERGY RECOVERY SYSTEM

(71) Applicants: Kobe Steel, Ltd., Kobe-shi (JP); ASAHI SHIPPING CO., LTD., Minato-ku (JP); TSUNEISHI SHIPBUILDING Co., Ltd., Fukuyama-shi (JP); MIURA Co., Ltd., Matsuyama-shi (JP)

(72) Inventors: Yuji Tanaka, Kobe (JP); Kazuo Takahashi, Kobe (JP); Shigeto Adachi, Takasago (JP); Yutaka Narukawa, Takasago (JP)

(73) Assignees: Kabushiki Kaisha Kobe Seiko Sho (Kobe Steel, Ltd.), Kobe-shi (JP); ASAHI SHIPPING CO., LTD., Minato-ku (JP); TSUNEISHI SHIPBUILDING Co., Ltd., Fukuyama-shi (JP); MIURA Co., Ltd., Matsuyama-shi (JP)

( * ) Notice: Subject to any disclaimer, the term of this patent is extended or adjusted under 35 U.S.C. 154(b) by 120 days.

(21) Appl. No.: 15/239,098

(22) Filed: Aug. 17, 2016

(65) Prior Publication Data

US 2017/0089295 A1 Mar. 30, 2017

(30) Foreign Application Priority Data

Sep. 29, 2015 (JP) ..... 2015-190955

(51) Int. Cl.
*F02G 5/00* (2006.01)
*F22D 5/18* (2006.01)
(Continued)

(52) U.S. Cl.
CPC ..... *F02G 5/00* (2013.01); *F01K 3/18* (2013.01); *F01K 13/02* (2013.01); *F01K 23/02* (2013.01);
(Continued)

(58) Field of Classification Search
CPC .. F02G 5/00; F22D 5/18; F22B 35/007; F22B 1/1838; F01K 27/02; F01K 3/18; F01K 23/02; F01K 13/02; F01K 23/101
(Continued)

(56) References Cited

U.S. PATENT DOCUMENTS 5,241,817 A * 9/1993 George, Jr. ..... F01C 20/04 60/39.182
2007/0227472 A1* 10/2007 Takeuchi ..... F01P 3/20 123/41.19
(Continued)

FOREIGN PATENT DOCUMENTS

CN 101243243 A 8/2008
CN 103033004 A 4/2013
(Continued)

OTHER PUBLICATIONS

Combined Office Action and Search Report dated Aug. 29, 2017 in Chinese Patent Application No. 201610772850.2 (with English Summary of Office Action obtained from the EPO Global Dossier and an English Translation of Category of Cited Documents).
(Continued)

*Primary Examiner* — Hoang Nguyen
(74) *Attorney, Agent, or Firm* — Oblon, McClelland, Maier & Neustadt, L.L.P.

(57) ABSTRACT

A heat energy recovery system includes an evaporator, a superheater, an expander, a power recovery device, a condenser, a pump, and a controller. The controller includes: an engine load calculation section; a maximum rotation speed determination section for determining a maximum rotation speed of the pump which is obtained when a pinch temperature reaches a target pinch temperature, based on a relational expression representing a relationship between the engine load and the maximum rotation speed, and an engine load; and a rotation speed regulation section for regulating
(Continued)

the rotation speed of the pump in such a way as to allow the degree of superheat of the working medium flowing into the expander to be equal to or greater than a reference value, and to allow the rotation speed to be equal to or less than a maximum rotation speed determined by the maximum rotation speed determination section.

5 Claims, 5 Drawing Sheets

(51) Int. Cl.

| | |
|---|---|
| ***F22B 35/00*** | (2006.01) |
| ***F01K 3/18*** | (2006.01) |
| ***F01K 13/02*** | (2006.01) |
| ***F01K 23/02*** | (2006.01) |
| ***F01K 23/10*** | (2006.01) |
| ***F01K 27/02*** | (2006.01) |
| ***F22B 1/18*** | (2006.01) |

(52) U.S. Cl.
CPC ..... *F01K 23/101* (2013.01); *F01K 27/02* (2013.01); *F22B 1/1838* (2013.01); *F22B 35/007* (2013.01); *F22D 5/18* (2013.01)

(58) Field of Classification Search
USPC ..... 60/605.1, 614, 616, 618, 660, 667
See application file for complete search history.

(56) References Cited

U.S. PATENT DOCUMENTS

| | | | | |
|---|---|---|---|---|
| 2009/0211253 | A1 | 8/2009 | Radcliff et al. | |
| 2013/0074497 | A1* | 3/2013 | Mori | F01K 23/10 60/615 |
| 2014/0033710 | A1* | 2/2014 | Mori | F01K 13/00 60/643 |
| 2014/0202134 | A1 | 7/2014 | Neunteufl et al. | |
| 2015/0337690 | A1* | 11/2015 | Adachi | F01K 13/02 60/660 |

FOREIGN PATENT DOCUMENTS

| | | | |
|---|---|---|---|
| CN | 103671052 | A | 3/2014 |
| CN | 103781997 | A | 5/2014 |
| JP | 2011-74897 | | 4/2011 |
| WO | WO 2013/046791 | A1 | 4/2013 |
| WO | WO 2013/108867 | A1 | 7/2013 |

OTHER PUBLICATIONS

Extended European Search Report dated Feb. 7, 2017 in Patent Application No. 16185262.9.

* cited by examiner

HEAT ENERGY RECOVERY SYSTEM

TECHNICAL FIELD

The present invention relates to a heat energy recovery system.

BACKGROUND ART

Conventionally, heat energy recovery systems are known which recover waste heat of supercharged air to be supplied to an engine. For example, Japanese Unexamined Patent Publication No. 2011-74897 (hereinafter, referred to as "Patent Literature 1") discloses a heat energy recovery system (fluid machine drive system) including an evaporator (second heat exchanger), a superheater (third heat exchanger), an expander for expanding working medium flown from the superheater, a fluid machine connected to the expander, a condenser for condensing the working medium flown from the expander, and a circulation pump for causing the working medium to flow from the condenser to the evaporator. The evaporator performs heat exchange between supercharged air discharged from an air compressor to be supplied to an engine and the working medium, to thereby evaporate the working medium. The superheater performs heat exchange between vapor flown from an exhaust gas boiler and the working medium flown from the evaporator to thereby heat the working medium.

Usually in such a system, the circulation amount of the working medium (rotation speed of the circulation pump) is controlled in such a way as to allow the degree of superheat of the working medium flowing into the expander to be within a specific range in order to prevent damage of the expander caused when the working fluid flows into the expander in liquid form, and to recover as much power as possible via the expander.

However, in the heat energy recovery system disclosed in Patent Literature 1, the amount of the heating medium (supercharged air) supplied to the evaporator and the amount of the heating medium (vapor) supplied to the superheater can change independently of each other. Consequently, when the rotation speed of the pump is controlled in such a way as to allow the degree of superheat of the working medium flowing into the expander to be within the specific range, the power recovery via the expander may become unstable.

For example, when the amount of the heating medium supplied to the superheater (the amount of heat put into the superheater) increases, the degree of superheat of the working medium flown from the superheater also increases. Accordingly, the rotation speed of the pump is increased in order to increase the circulation amount of the working medium. This, however, may make the pinch temperature (value obtained by subtracting a saturation temperature of the working medium from a temperature of the supercharged air) $\Delta T$ in the evaporator too small (see FIG. 5). In this case, the evaporation of the working medium in the evaporator becomes unstable, which makes the driving of the expander, i.e. the power recovery, unstable. Specifically, even though the frequency of the pump is constant, the suction pressure of the expander changes in various degrees and consequently, the output of the fluid machine changes. On the other hand, when the amount of the supercharged air to be supplied to the evaporator (the amount of heat put into the evaporator) decreases, the pinch temperature $\Delta T$ also decreases, which therefore makes the power recovery via the expander unstable in the same manner as in the above-described case. It should be noted that FIG. 5 is a graph showing relationships between the amount of exchanged heat and the temperature of heating mediums (supercharged air and vapor) and between the amount of exchanged heat and the temperature of the working medium in the evaporator.

SUMMARY OF INVENTION

The present invention aims to provide a heat energy recovery system capable of achieving stable power recovery via an expander while preventing damage of the expander.

In order to solve the problems described above, it is considered to control the rotation speed of the pump in such a manner as to allow the pinch temperature in the evaporator to be equal to or greater than a target pinch temperature, based on the degree of superheat of the working medium flowing into the expander. Here, the calculation of a pinch temperature requires the flow rate of the supercharged air flowing into the evaporator, the temperature of the supercharged air flown from the evaporator, or the like. However, it is difficult to measure the flow rate of the supercharged air flowing into the evaporator. For example, it is considered as a solution to insert an orifice into a portion of the flow channel on the upstream side or downstream side of the heat exchanger to measure a pressure differential between the front and the rear of the heat exchanger or to measure a pressure differential between the front and the rear of the heat exchanger without insertion of the orifice. However, the insertion of the orifice is difficult due to lack of space. In addition, the pressure differential between the front and the rear of the heat exchanger changes, and measurement of a minute differential "less than several tens of Pa" is required. It is therefore difficult to actually measure the front-rear differential. Thus, it is difficult to measure the flow rate of the supercharged air. Further, the temperature of the supercharged air passing through the evaporator is affected by the heat capacity of the evaporator, and therefore follows a change in the flow rate of the supercharged air with a time lag. It is therefore difficult to accurately calculate the pinch temperature which changes according to the flow rate, the temperature, and the like of the supercharged air.

Accordingly, the inventors of the present invention have conducted intensive studies and found that the engine load has a constant correlation with the flow rate and the temperature of the supercharged air, i.e. the pinch temperature can be calculated based on the engine load. On the other hand, it is known that the flow rate of the working medium and the pressure of the working medium flowing into the evaporator, which are the necessary factors for the calculation of the pinch temperature, have a constant correlation with the rotation speed of the pump. Based on these findings, the inventors have discovered that there is a correlation between the engine load and the rotation speed of the pump obtained when the pinch temperature reaches a target pinch temperature, and that it is possible to control the rotation speed of the pump while achieving the target pinch temperature by calculating the correlation in advance.

The present invention has been made in view of the above-described circumstances. A heat energy recovery system according to an aspect of the present invention comprises: an evaporator for performing heat exchange between supercharged air to be supplied to an engine and working medium to thereby evaporate the working medium; a superheater for performing heat exchange between the working medium flown from the evaporator and heating medium to thereby heat the working medium; an expander for expanding the working medium flown from the superheater; a power recovery device connected to the expander; a condenser for condensing the working medium flown from the expander; a pump for causing the working medium to flow from the condenser to the evaporator; and a controller including an engine load calculation section for calculating an engine load, a maximum rotation speed determination section for determining a maximum rotation speed which is a rotation speed of the pump obtained when a pinch temperature reaches a target pinch temperature, the pinch temperature being a value which is obtained by subtracting a saturation temperature of the working medium from a temperature of the supercharged air in the evaporator, the determination being based on a relational expression representing a relationship between the engine load and the maximum rotation speed, and an engine load calculated by the engine load calculation section, and a rotation speed regulation section for regulating the rotation speed of the pump in such a way as to allow the degree of superheat of the working medium flowing into the expander to be equal to or greater than a reference value, and to allow the rotation speed to be equal to or less than a maximum rotation speed determined by the maximum rotation speed determination section.

These and other objects, features and advantages of the present invention will become more apparent upon reading the following detailed description along with the accompanying drawings.

DESCRIPTION OF EMBODIMENTS

A heat energy recovery system according to an embodiment of the present invention will be described with reference to FIGS. 1 to 4.

Figure 1:
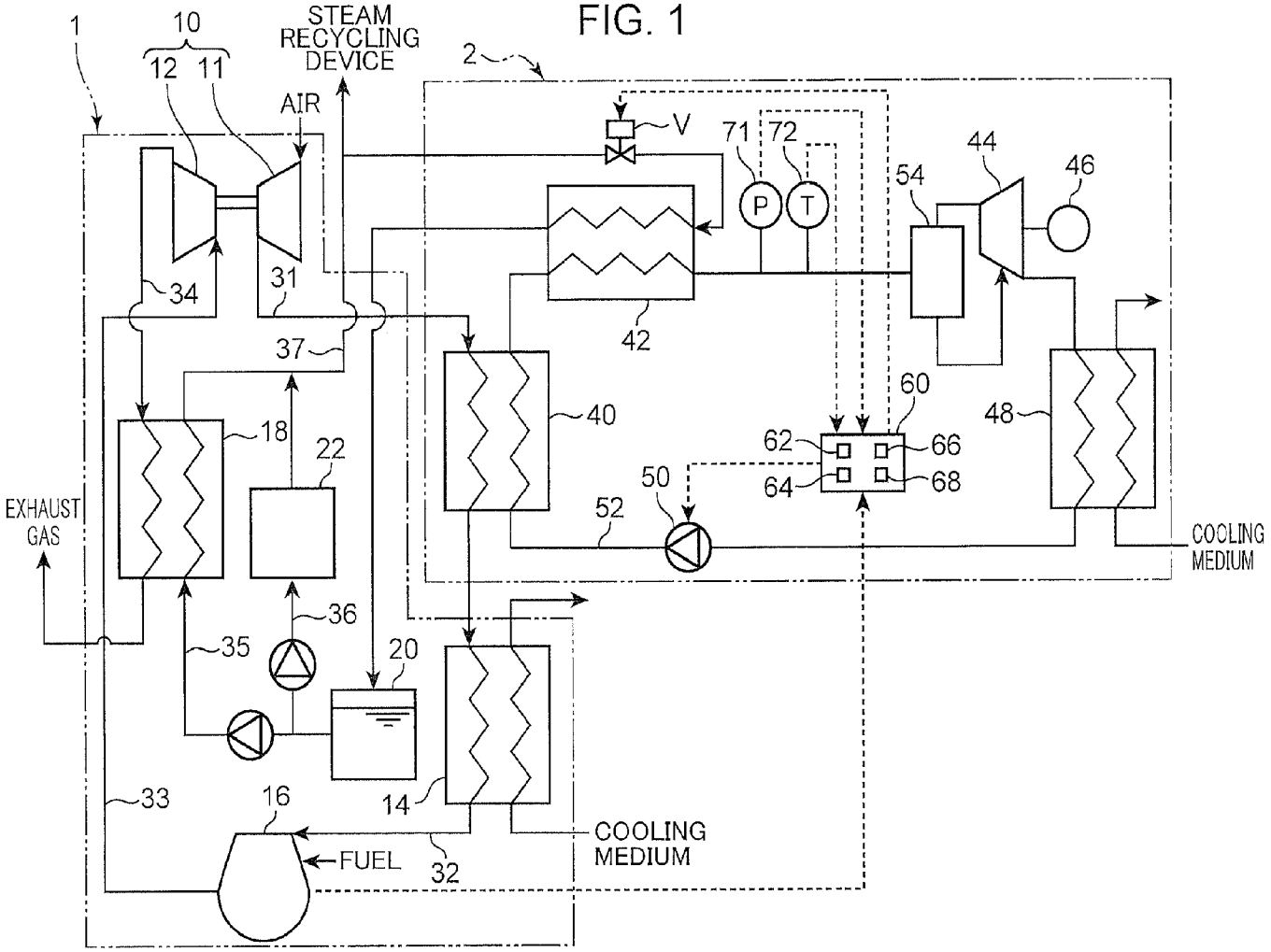
FIG. 1 is a diagram showing an overview of the configuration of a heat energy recovery system according to an embodiment of the present invention.

As shown in FIG. 1, the heat energy recovery system includes a supercharger-equipped engine 1, and a heat energy recovery device 2 which recovers waste heat from the supercharger-equipped engine 1. In the present embodiment, the heat energy recovery system is installed in a ship, but may be installed on an internal combustion engine other than a ship engine.

First, the supercharger-equipped engine 1 is described. The supercharger-equipped engine 1 includes a supercharger 10, an air cooler 14, an engine 16 (ship engine 16), a heat exchanger 18, a tank 20 which stores water, and a boiler 22.

The supercharger 10 includes a compressor 11 which compresses air, and a turbine 12 connected to the compressor 11. Supercharged air is discharged from the compressor 11 to flow to the air cooler 14 through a first air intake line 31.

The air cooler 14 performs heat exchange between the supercharged air discharged from the compressor 11 and cooling medium to thereby cool the supercharged air. In the present embodiment, seawater is used as the cooling medium. The supercharged air is caused to flow from the air cooler 14 to the engine 16 through a second air intake line 32. Further, fuel is also supplied to the engine 16. Exhaust gas is discharged from the engine 16 to flow into the turbine 12 through a first exhaust line 33.

The turbine 12 is driven by expansion energy of the exhaust gas to exert a driving force to the compressor 11. The exhaust gas is caused to flow from the turbine 12 to the heat exchanger 18 through a second exhaust line 34. The heat exchanger 18 performs heat exchange between the exhaust gas discharged from the turbine 12 and water to thereby evaporate the water (generate steam).

The heat exchanger 18 is supplied with water stored in the tank 20 through a first water supply line 35. The boiler 22 is also supplied with water stored in the tank 20 through a second water supply line 36. Steam of the heat exchanger 18 and steam of the boiler 22 are supplied to a steam recycling device other than the heat energy recovery device 2 and to a superheater 42 described later. An opening adjustable valve V is disposed in the steam line 37.

Now, the heat energy recovery device 2 is described. The heat energy recovery device 2 includes an evaporator 40, the superheater 42, an expander 44, a power recovery device 46, a condenser 48, a pump 50, a circulation flow channel 52 which connects the evaporator 40, the superheater 42, the expander 44, the condenser 48, and the pump 50 in series in this order, and a controller 60 which performs various controls.

The evaporator 40 is disposed in the first air intake line 31. The evaporator 40 performs heat exchange between the supercharged air discharged from the compressor 11 to flow into the air cooler 14 and working medium in liquid form to thereby heat the working medium or evaporate at least a portion of the working medium.

The superheater 42 is disposed at a portion of the circulation flow channel 52 on the downstream side of the evaporator 40. Further, the superheater 42 is connected to the steam line 37. The superheater 42 performs heat exchange between the working medium flown from the evaporator 40 and the steam (heating medium) supplied through the steam line 37 to thereby heat the working medium. In other words, in the present embodiment, steam is used as the heating medium supplied to the superheater 42.

The expander 44 is disposed at a portion of the circulation flow channel 52 on the downstream side of the superheater 42. The expander 44 expands the working medium in vapor form flown from the superheater 42. In the present embodiment, a displacement type screw expander is used as the expander 44 which includes rotors configured to be driven for rotation by expansion energy of the working medium in vapor form flown from the superheater 42. Specifically, the expander 44 includes a pair of male and female screw rotors.

The power recovery device 46 is connected to the expander 44. In the present embodiment, a power generator is used as the power recovery device 46. The power recovery device 46 includes a rotary shaft connected to one of the pair of screw rotors of the expander 44. The rotary shaft rotates with rotation of the screw rotors to thereby allow the power recovery device 46 to generate electric power. It is possible to use a condenser or the like as the power recovery device 46 in place of a power generator.

In the present embodiment, an oil separator 54 is disposed at a portion of the circulation flow channel 52 between the superheater 42 and the expander 44. The oil separator 54 separates lubricant oil included in the working medium. The oil separated by the oil separator 54 is supplied to the expander 44, more specifically, to bearings of the screw rotors.

The condenser 48 is disposed at a portion of the circulation flow channel 52 on the downstream side of the expander 44. The condenser 48 performs heat exchange between the working medium flown from the expander 44 and cooling medium to thereby condense the working medium. In the present embodiment, seawater is used as the cooling medium supplied to the condenser 48.

The pump 50 is disposed at a portion of the circulation flow channel 52 on the downstream side of the condenser 48 (a portion between the condenser 48 and the evaporator 40). The pump 50 pressurizes the working medium in liquid form condensed by the condenser 48 to a predetermined pressure, and sends the pressurized working medium to the evaporator 40. A centrifugal pump including an impeller as a rotor, a gear pump including a rotor consisting of a pair of gears, or the like, is used as the pump 50.

The controller 60 controls the rotation speed f (frequency f) of the pump 50 in such a way as to allow the degree of superheat Tsh of the working medium flowing into the expander 44 (working medium flowing in a portion of the circulation flow path 52 between the superheater 42 and the expander 44) to be equal to or greater than a reference value, and to allow the rotation speed f to be equal to or greater than a maximum rotation speed fmax of the pump 50 which is determined based on an engine load. Specifically, the controller 60 includes an engine load calculation section 62, a maximum rotation speed determination section 64, a rotation speed regulation section 66, and a heating medium regulation section 68.

The engine load calculation section 62 calculates an engine load. In the present embodiment, the engine load calculation section 62 calculates an engine load based on the amount of fuel supplied to the engine 16.

Figure 3:
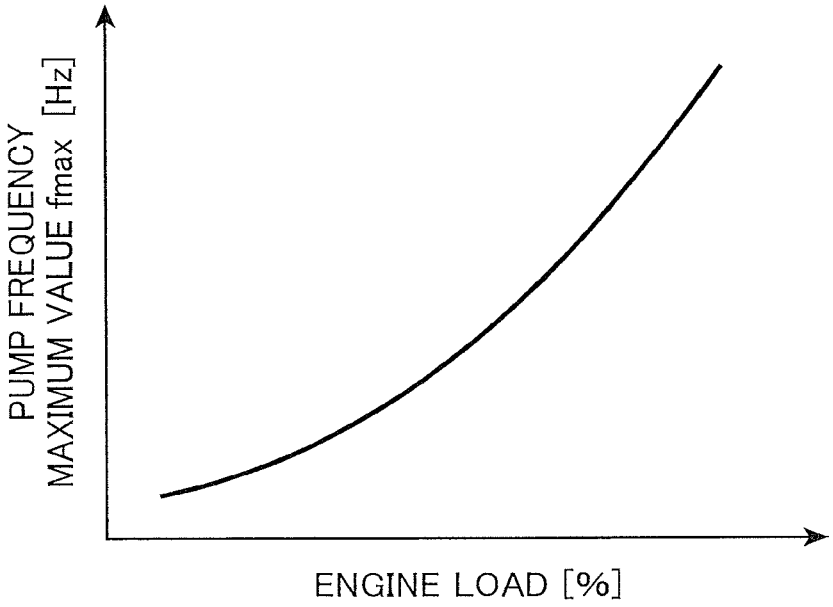
FIG. 3 is a graph showing a relationship between the engine load and the maximum rotational speed (maximum frequency) of a pump.
Figure 4:
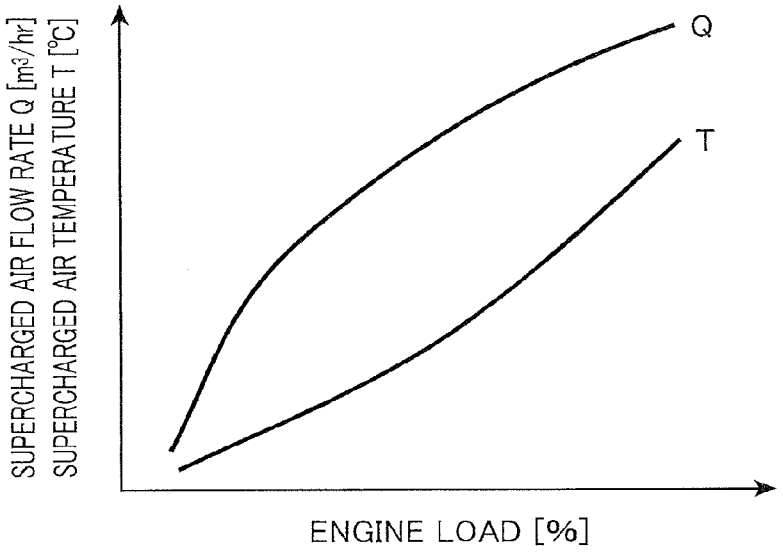
FIG. 4 is a graph showing a relationship between the engine load and the flow rate Q of supercharged air, and a relationship between the engine load and the temperature T of the supercharged air.
Figure 5:
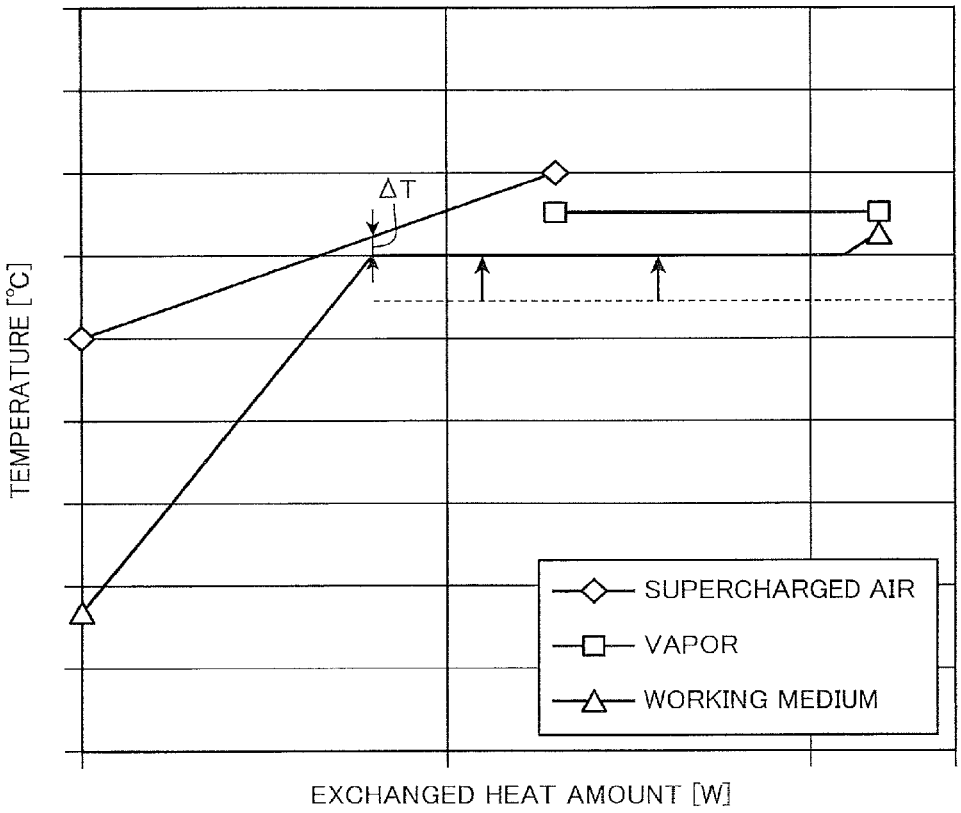
FIG. 5 is a graph showing relationships between the amount of exchanged heat and the temperature of heating mediums (supercharged air and vapor) and between the amount of exchanged heat and the temperature of a working medium in an evaporator.

The maximum rotation speed determination section 64 determines a maximum rotation speed fmax based on an engine load calculated by the engine load calculation section 62 by using a relational expression (see FIG. 3) representing a relationship between the engine load and the maximum rotation speed fmax of the pump 50. The maximum rotation speed fmax is a rotation speed f of the pump 50 obtained when a pinch temperature reaches a target pinch temperature, the pinch temperature being a value which is obtained by subtracting a saturation temperature of the working medium in the evaporator 40 from a temperature of the supercharged air in the evaporator 40. The relational expression shown in FIG. 3 is calculated in advance based on the relationships shown in FIG. 4 (a relationship between the engine load and the temperature T of the supercharged air and a relationship between the engine load and the flow rate Q of the supercharged air), the heat transfer performance of the evaporator 40, and the like, and is stored in the controller 60.

The rotation speed regulation section 66 regulates the rotation speed f of the pump 50 in such a way as to allow the degree of superheat Tsh of the working medium flowing into the expander 44 to be equal to or greater than a reference value (which is lower than a target degree of superheat Ts by a predetermined value 1), and to allow the rotation speed f to be equal to or less than a maximum rotation speed fmax determined by the maximum rotation speed determination section 64. Further, when the degree of superheat Tsh is equal to or greater than the reference value, and the rotation speed f of the pump 50 is equal to or less than the maximum rotation speed fmax, the rotation speed regulation section 66 increases the rotation speed f of the pump 50 so that and the degree of superheat Tsh is equal to or less than a specified value (which is higher than the target degree of superheat Ts by a predetermined value $\alpha$), while keeping the rotation speed f equal to or less than the maximum rotation speed fmax. The predetermined value $\beta$ means a negative allowable deviation from the target degree of superheat Ts, and the predetermined value $\alpha$ means a positive allowable deviation from the target degree of superheat Ts. The degree of superheat Tsh is calculated based on a detection value of each of a pressure sensor 71 and a temperature sensor 72 disposed at a portion of the circulation flow channel 52 between the superheater 42 and the oil separator 54.

The heating medium regulation section 68 reduces, when the rotation speed f of the pump 50 is equal to the maximum rotation speed fmax and the degree of superheat Tsh of the working medium flowing into the expander 44 is greater than the specified value, the amount of the heating medium to be supplied to the superheater 42 (in the present embodiment, the opening of the valve V) so that the degree of superheat Tsh is equal to or less than the specified value.

Figure 2:
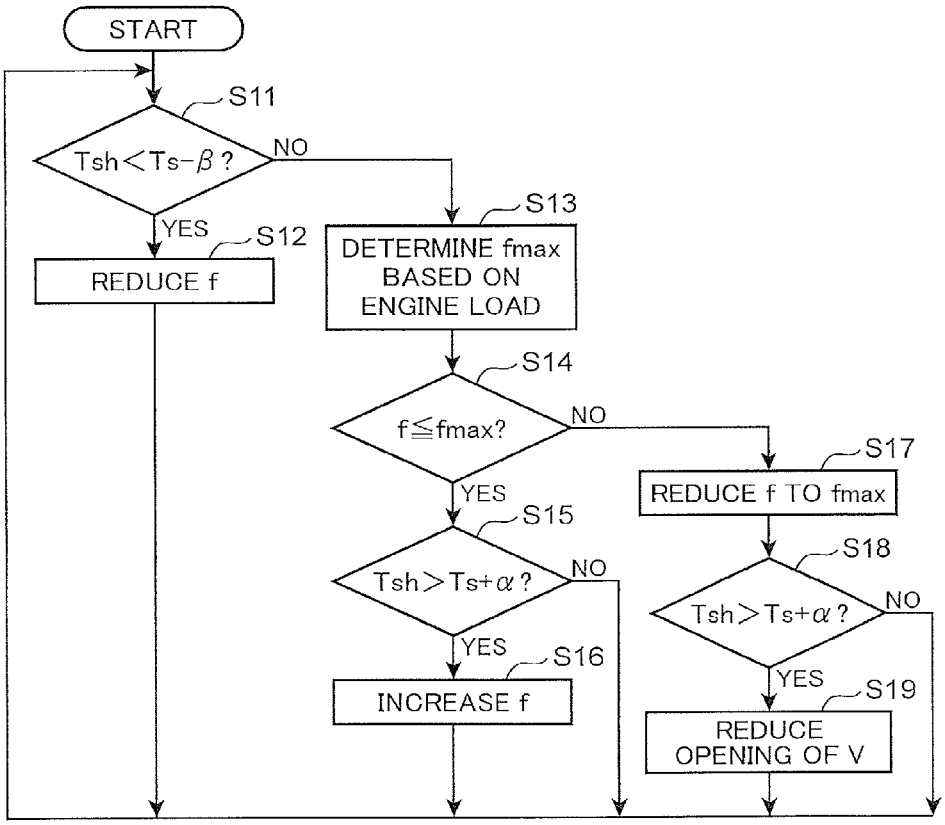
FIG. 2 is a flowchart illustrating control operations of a controller.

Hereinafter, control operations of the controller 60 are described with reference to FIG. 2.

When the main system starts operating, the controller 60 determines whether the degree of superheat Tsh of the working medium flowing into the expander 44 is less than the reference value (which is lower than the target degree of superheat Ts by the predetermined value $\beta$) (step S11). In the case that the degree of superheat Tsh is less than the reference value, the controller 60 (rotation speed regulation section 66) reduces the rotation speed f of the pump 50 (step S12), and returns to step S11. On the other hand, in the case that the degree of superheat Tsh is equal to or greater than the reference value, the controller 60 (maximum rotation speed determination section 64) determines a maximum rotation speed fmax, which is a maximum value of the rotation speed f of the pump 50, based on an engine load (step S13).

Subsequently, the controller 60 determines whether the current rotation speed f of the pump 50 is equal to or less than the maximum rotation speed fmax (or whether a pinch temperature is equal to or greater than the target pinch temperature) (step S14). In the case that the pinch temperature is greater than the target pinch temperature (or in the case that it is allowable to increase the rotation speed f of the pump 50), the controller 60 determines whether the degree of superheat Tsh is greater than the specified value (which is higher than the target degree of superheat Ts by the predetermined value $\alpha$) (step S15). In the case that the degree of superheat Tsh is greater than the specified value, i.e. it is allowable to reduce both the pinch temperature and the degree of superheat (or in the case that it is allowable to increase the amount of power recovered by the power recovery device 46), the controller 60 (rotation speed regulation section 66) increases the rotation speed f of the pump 50 (step S16), and returns to step S11. On the other hand, in the case that the degree of superheat Tsh is equal to or less than the specified value (NO at step S15), the controller 60 returns to step S11 directly without adjusting the rotation speed f of the pump 50.

Further, in the case that at step S14 the rotation speed f of the pump 50 is greater than the maximum rotation speed fmax, i.e. in the case that the pinch temperature is smaller than the target pinch temperature, the controller 60 (rotation speed regulation section 66) reduces the rotation speed f of the pump 50 to the maximum rotation speed fmax (step S17).

Subsequently, the controller 60 determines whether the degree of superheat Tsh is greater than the specified value (step S18). In the case that the degree of superheat Tsh is greater than the specified value, i.e. in the case that the degree of superheat Tsh is too high although the rotation speed f of the pump 50 cannot be increased, the controller 60 (heating medium regulation section 68) reduces the opening of the valve V in order to reduce the amount of the heating medium (steam) to be supplied to the superheater 42 (step S19), and returns to step S11. On the other hand, in the case that the degree of superheat Tsh is equal to or less than the specified value (NO at step S18), the controller 60 returns to step S11 directly without adjusting the opening of the valve V.

As described above, in this heat energy recovery system, the rotation speed f of the pump 50 is regulated in such a way as to allow the degree of superheat Tsh to be equal to or greater than the reference value. Therefore, damage of the expander 44 can be prevented. Further, the rotation speed f of the pump 50 is regulated to be equal to or less than the maximum rotation speed fmax determined based on the relational expression, i.e. the pinch temperature is caused to be equal to or greater than the target pinch temperature in the evaporator 40. Consequently, the working medium sufficiently evaporates in the evaporator 40, which can make the power recovery via the expander 44 stable.

Further, in the embodiment described above, when the degree of superheat Tsh is equal to or greater than the reference value, and the rotation speed f of the pump 50 is equal to or less than the maximum rotation speed fmax, the rotation speed regulation section 66 increases the rotation speed f of the pump 50 so that the degree of superheat Tsh is equal to or less than the specified value, while keeping the rotation speed f equal to or less than the maximum rotation speed fmax. This makes it possible to increase the amount of power recovered by the power recovery device 46 while maintaining both the prevention of damage of the expander 44 and the stable power recovery via the expander 44.

Further, in the embodiment described above, the heating medium regulation section 68 reduces, when the rotation speed f of the pump 50 is equal to the maximum rotation speed fmax and the degree of superheat Tsh is greater than the specified value, the amount of the heating medium (steam) to be supplied to the superheater 42 so that the degree of superheat Tsh is equal to or less than the specified value. This can prevent an excessive supply of heating medium to the superheater 42.

It should be noted that the embodiment disclosed here is exemplary in all respects and should not be regarded as restrictive. The scope of the present invention is indicated by the scope of the claims and not by the description given above, and includes all modifications within the same sense and scope as the claims.

For example, the embodiment described above shows an example in which the engine load calculation section 62 calculates an engine load based on the amount of fuel supplied to the engine 16, but the engine load calculation section 62 may be configured to calculate an engine load based on the rotation speed of the compressor 11 of the supercharger 10. Such a configuration allows indirect calculation of an engine load which does not require use of a signal related to the engine 16.

Alternatively, the engine load calculation section 62 may be configured to calculate an engine load based on a pressure differential between the front and the rear of the evaporator 40 (which is a value obtained by subtracting a pressure at a portion of the first air intake line 31 on the downstream side of the evaporator 40 from a pressure at a portion of the first air intake line 31 on the upstream side of the evaporator 40).

Further, a plate heat exchanger may be used as the superheater 42, and a pressure regulating valve may be used in place of the valve V, the pressure regulating valve being operable to determine a maximum value of the pressure of steam that flows into the plate heat exchanger. In this case, the maximum value of the pressure regulating valve is set in such a way as to allow the saturation temperature of steam flowing into the plate heat exchanger to be equal to or less than a predetermined temperature of working medium flown from the plate heat exchanger. This allows operation of the heat energy recovery device 2. In this case, the heating medium regulation section 68 (steps S18 and S19) is omitted.

The embodiment described above is summarized below.

A heat energy recovery system according to the embodiment described above comprises: an evaporator for performing heat exchange between supercharged air to be supplied to an engine and working medium to thereby evaporate the working medium; a superheater for performing heat exchange between the working medium flown from the evaporator and heating medium to thereby heat the working medium; an expander for expanding the working medium flown from the superheater; a power recovery device connected to the expander; a condenser for condensing the working medium flown from the expander; a pump for causing the working medium to flow from the condenser to the evaporator; and a controller including an engine load calculation section for calculating an engine load, a maximum rotation speed determination section for determining a maximum rotation speed which is a rotation speed of the pump obtained when a pinch temperature reaches a target pinch temperature, the pinch temperature being a value which is obtained by subtracting a saturation temperature of the working medium from a temperature of the supercharged air in the evaporator, the determination being based on a relational expression representing a relationship between the engine load and the maximum rotation speed, and an engine load calculated by the engine load calculation section, and a rotation speed regulation section for regulating the rotation speed of the pump in such a way as to allow the degree of superheating of the working medium flowing into the expander to be equal to or greater than a reference value, and to allow the rotation speed to be equal to or less than a maximum rotation speed determined by the maximum rotation speed determination section.

In this energy recovery system, the rotation speed of the pump is regulated in such a way as to allow the degree of superheat of the working medium flowing into the expander to be equal to or greater than the reference value. Therefore, damage of the expander can be prevented. Further, the rotation speed of the pump is regulated to be equal to or less than the maximum rotation speed determined based on the relational expression, i.e. the pinch temperature is caused to be equal to or greater than the target pinch temperature in the evaporator. Consequently, the working medium sufficiently evaporates in the evaporator, which can make the power recovery via the expander stable.

In this configuration, it is preferred that, when the degree of superheat of the working medium flowing into the expander is equal to or greater than the reference value, and the rotation speed of the pump is equal to or less than the maximum rotation speed, the rotation speed regulation section increases the rotation speed of the pump so that the degree of superheat of the working medium flowing into the expander is equal to or less than a specified value higher than the reference value, while keeping the rotation speed equal to or less than the maximum rotation speed.

Such a configuration makes it possible to increase the amount of power recovered by the power recovery device while maintaining both the prevention of damage of the expander and the stable power recovery via the expander.

Further, in this configuration, it is preferred that the controller further includes a heating medium regulation section for reducing, when the rotation speed of the pump is equal to the maximum rotation speed and the degree of superheat of the working medium flowing into the expander is greater than the specified value, the amount of the heating medium to be supplied to the superheater so that the degree of superheat is equal to or less than the specified value.

Such a configuration can prevent an excessive supply of heating medium to the superheater.

Further, in the heat energy recovery system described above, the engine load calculation section may be configured to calculate an engine load based on the amount of fuel supplied to the engine.

This configuration allows easy calculation of an engine load.

Alternatively, the engine load calculation section may be configured to calculate an engine load based on the rotation speed of a supercharger which supplies the supercharged air to the engine.

This configuration allows indirect calculation of an engine load which does not require use of a signal related to the engine.

This application is based on Japanese Patent application No. 2015-190955 filed in Japan Patent Office on Sep. 29, 2015, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A heat energy recovery system, comprising:

an evaporator for performing heat exchange between supercharged air to be supplied to an engine and working medium to thereby evaporate the working medium;

a superheater for performing heat exchange between the working medium flown from the evaporator and heating medium to thereby heat the working medium;

an expander for expanding the working medium flown from the superheater;

a power recovery device connected to the expander;

a condenser for condensing the working medium flown from the expander;

a pump for causing the working medium to flow from the condenser to the evaporator; and a controller including an engine load calculation section for calculating an engine load, a maximum rotation speed determination section for determining a maximum rotation speed which is a rotation speed of the pump obtained when a pinch temperature reaches a target pinch temperature, the pinch temperature being a value which is obtained by subtracting a saturation temperature of the working medium from a temperature of the supercharged air in the evaporator, the determination being based on a relational expression representing a relationship between the engine load and the maximum rotation speed, and an engine load calculated by the engine load calculation section, and a rotation speed regulation section for regulating the rotation speed of the pump in such a way as to allow the degree of superheat of the working medium flowing into the expander to be equal to or greater than a reference value, and to allow the rotation speed to be equal to or less than a maximum rotation speed determined by the maximum rotation speed determination section.

2. The heat energy recovery system according to claim 1, wherein when the degree of superheat of the working medium flowing into the expander is equal to or greater than the reference value, and the rotation speed of the pump is equal to or less than the maximum rotation speed, the rotation speed regulation section increases the rotation speed of the pump so that the degree of superheat of the working medium flowing into the expander is equal to or less than a specified value higher than the reference value, while keeping the rotation speed equal to or less than the maximum rotation speed.

3. The heat energy recovery system according to claim 2, wherein the controller further includes a heating medium regulation section for reducing, when the rotation speed of the pump is equal to the maximum rotation speed and the degree of superheat of the working medium flowing into the expander is greater than the specified value, the amount of the heating medium to be supplied to the superheater so that the degree of superheat is equal to or less than the specified value.

4. The heat energy recovery system according to claim 1, wherein the engine load calculation section calculates an engine load based on the amount of fuel supplied to the engine.

5. The heat energy recovery system according to claim 1, wherein the engine load calculation section calculates an engine load based on the rotation speed of a supercharger which supplies the supercharged air to the engine.

* * * * *